US006824330B2

(12) United States Patent
Grobe

(10) Patent No.: US 6,824,330 B2
(45) Date of Patent: Nov. 30, 2004

(54) CONSTANT TENSION STEEL CATENARY RISER SYSTEM

(75) Inventor: Avie Max Grobe, Houston, TX (US)

(73) Assignee: Coflexip S.A., Paris la Defense (FR)

( * ) Notice: Subject to any disclaimer, the term of this patent is extended or adjusted under 35 U.S.C. 154(b) by 14 days.

(21) Appl. No.: 10/247,764

(22) Filed: Sep. 19, 2002

(65) Prior Publication Data

US 2004/0057798 A1 Mar. 25, 2004

(51) Int. Cl.[7] ..... B63B 27/34

(52) U.S. Cl. ..... 405/224.4; 405/224.2; 441/4

(58) Field of Search ..... 405/224.2, 224.4, 405/173, 168.4; 166/352, 355; 441/4

(56) References Cited

U.S. PATENT DOCUMENTS 3,677,310 A * 7/1972 Dobler et al. ..... 441/4
4,023,517 A * 5/1977 Ryan ..... 405/224.2
4,065,822 A * 1/1978 Wilbourn ..... 441/4
4,421,173 A * 12/1983 Beakley et al. ..... 166/355
4,570,716 A * 2/1986 Genini et al. ..... 166/355
4,587,919 A * 5/1986 Loire et al. ..... 114/230.1
4,645,467 A * 2/1987 Pollack ..... 441/4
4,733,991 A 3/1988 Myers
5,479,990 A * 1/1996 Peppel ..... 405/224.4
5,582,252 A * 12/1996 Richmond et al. ..... 166/352
5,639,187 A 6/1997 Mungall et al.
5,957,074 A 9/1999 de Baan et al.
6,062,769 A * 5/2000 Cunningham ..... 405/195.1
6,257,801 B1 7/2001 Kelm et al.
6,386,798 B2 5/2002 Finn

* cited by examiner

*Primary Examiner*—Frederick L. Lagman
(74) *Attorney, Agent, or Firm*—Klein, O'Neill & Singh, LLP; Howard J. Klein

(57) ABSTRACT

A steel catenary riser (SCR) system includes a tensioning mechanism on a floating facility that controllably applies a substantially constant tension to an SCR that is fluidly coupled to the facility by a flexible jumper conduit. More specifically, the system includes a tensioning device located on the floating facility; and an SCR having an upper portion, which, in the preferred embodiment, extends above the surface of the body of water. The upper portion of the SCR is connected to the tensioning device by a connection element, such as a cable, chain, rope, or wire, whereby tension is controllably applied from the tensioning device to the SCR. A flexible jumper conduit is fluidly connected between the upper portion of the SCR and the floating facility for conducting fluid from the SCR to the floating facility. In a preferred embodiment, the connection element is attached to the upper portion of the SCR at an attachment point, and the flexible jumper conduit is fluidly coupled to the SCR near the attachment point.

6 Claims, 1 Drawing Sheet

CONSTANT TENSION STEEL CATENARY RISER SYSTEM

CROSS-REFERENCE TO RELATED APPLICATIONS

Not Applicable

FEDERALLY SPONSORED RESEARCH OR DEVELOPMENT

Not Applicable

BACKGROUND OF THE INVENTION

The present invention relates to riser systems used in the offshore production of fluid hydrocarbons (e.g., petroleum and natural gas). More particularly, it relates to the field of steel catenary risers (SCRs), and specifically it relates to a system for attaching an SCR to a floating offshore facility or vessel, in which a substantially constant tension is applied to the SCR.

In the production of fluid hydrocarbons ("product") from undersea deposits, the movement of the product from the seabed to a surface facility, such as a floating production or storage platform or vessel, is critical. Typically, one or more conduits, or risers, are connected between a well-head or the like on the seabed and the surface facility.

Although the floating facility is typically moored or anchored, it is continuously exposed to a variety of forces from wind and water action that subject the facility to movements such as heave, roll, pitch, drift, and surge. Consequently, the riser system must be sufficiently compliant to compensate for such motion without experiencing undue stress and fatigue.

There have been a number of types of riser systems that have been developed to provide the requisite degree of compliance. One such system, as disclosed in, for example, U.S. Pat. No. 5,639,187—Mungall et al.; 6,257,801—Kelm et al.; and 5,957,074—de Baan et al., employs a plurality of rigid steel conduits that are laid between a subsea well or other fluid source on the seabed and a submerged buoy, the latter being tethered or moored to the seabed. The steel conduits are curved in a gentle catenary path between the seabed and the buoy, and are thus called "steel catenary risers" or "SCRs." A plurality of flexible "jumper" conduits are then connected between the buoy and the surface facility to conduct fluid from the SCR to the facility. This approach necessitates the additional expense and time of deploying and anchoring the buoy. Such expense makes the submerged buoy arrangement not particularly cost effective, except perhaps in those systems employing a large number of risers.

Another approach, exemplified in the disclosure of U.S. Pat. No. 6,386,798—Finn, is to connect one or more SCRs directly to the surface facility, in a manner that allows the SCRs to move as the surface facility moves. One drawback with arrangements of this type, however, is that movement of the surface facility causes the touchdown point of the SCRs on the seabed to change. This is especially disadvantageous in relatively shallow water, where significant surface facility motions translate into large movements of the touchdown point along the seabed, thereby subjecting the SCRs to excessive fatigue, with consequent shortened fatigue life.

Consequently, there has been a long-felt need for an SCR system that provides for significant compliance of the riser system to compensate for substantial surface facility motion without the disadvantages attendant to the aforementioned prior art systems.

SUMMARY OF THE INVENTION

Broadly the present invention is an SCR system comprising a tensioning mechanism on a floating facility that controllably applies a substantially constant tension to an SCR that is fluidly coupled to the facility by a flexible jumper conduit. More specifically, the invention is a steel catenary riser (SCR) system for use with a floating facility on the surface of a body of water, comprising a tensioning device located on the floating facility, an SCR having an upper portion, connection means, connecting the upper portion of the SCR to the tensioning device, for controllably applying tension from the tensioning device to the SCR, and a flexible jumper conduit fluidly connected between the upper portion of the SCR and the floating facility for conducting fluid from the SCR to the floating facility. In a preferred embodiment, the upper portion of the SCR extends above the surface of the body of water; the connection means is attached to the upper portion of the SCR at an attachment point; and the flexible jumper conduit is fluidly coupled to the SCR near the attachment point.

As will be more fully appreciated from the detailed description that follows, by the application of a substantially constant tension to the SCR regardless of the relative motion between the SCR and the floating facility, the present invention provides improved fatigue life as compared with the fixed connection arrangements of the prior art, while being substantially more cost effective than the submerged buoy arrangement, especially for systems with a small number of risers.

BRIEF DESCRIPTION OF THE DRAWING

The single

DETAILED DESCRIPTION OF THE INVENTION

Figure 1:
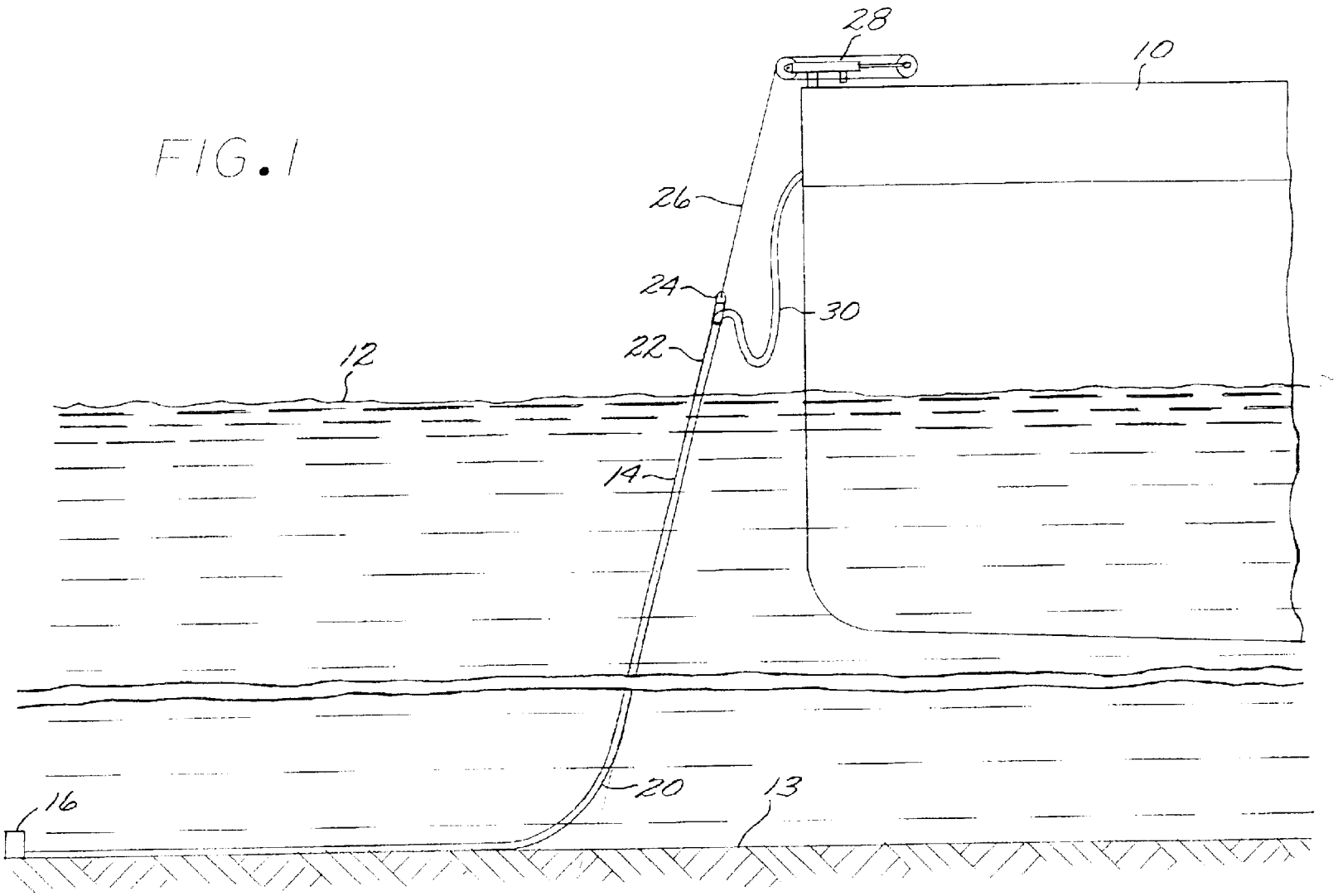
FIG. 1 illustrates, semi-diagrammatically, a constant tension SCR in accordance with a preferred embodiment of the present invention.

In FIG. 1, a constant tension SCR system, in accordance with a preferred embodiment of the invention, is shown in use with a floating facility 10 on a body of water 12. The floating facility 10 will typically be a semi-submersible offshore production vessel that is moored or anchored to the seabed 13 by conventional means (not shown), but the invention can be used with a large variety of floating facilities that are known in the art. The invention is particularly advantageous for use with a semi-submersible facility, however, because such a facility experiences motion and displacement such as heave, pitch, and surge due to environmental loads (i.e., from wind and water action).

A steel catenary riser (SCR) 14 extends from an undersea fixture 16 (such as a well-head) on the seabed 13. The SCR 14 bends upwardly from the seabed 13 in a gentle catenary curve 20 to an upper portion 22 that, in the preferred embodiment, extends well above the surface of the body of water 12. An attachment fitting 24, of any suitable type known in the art, is located at an attachment point on the upper portion 22 of the SCR 14. In the preferred embodiment, the attachment point is located above the surface of the body of water 12, as shown in the drawing. Connection means, comprising a connecting element 26 (for example, a cable, a chain, a synthetic rope or line, or a wire), connect a tensioning device 28 located on the floating facility 10 to the attachment fitting 24. The tensioning device

28 may be any suitable apparatus that is known for use in similar applications in the offshore oil production industry. Thus, the tensioning device 28 may be, for example, a winch, such as a linear, rotary or traction winch. In a preferred embodiment, the tensioning device is a short stroke hydraulic tensioner.

One end of a flexible jumper conduit 30 is fluidly connected, by a suitable fluid coupling (not shown), to the upper portion 22 of the SCR 14 near the attachment fitting 24. The other end of the jumper conduit 30 is fluidly connected to an appropriate site (not shown) on the floating facility 10, so that fluid can flow from the SCR 14 to the floating facility.

The tensioning device 28 is operated to apply a substantially constant tension to the SCR 14 through the connection means 26 as the floating facility 10 is moved by environmental forces. The flexible jumper conduit 30 allows a substantial degree of relative movement between the SCR 14 and the floating facility 10, but the tensioning device 28, acting through the connection means 26, stabilizes the SCR 14 and minimizes its movement. In this manner, the riser system (i.e., the SCR 14 and the jumper conduit 30) is sufficiently compliant to compensate for the motion of the floating facility 10 without subjecting the SCR 14 to undue motion-induced stress. Thus, the fatigue life of the SCR 14 is greatly improved in a highly cost-effective manner. Moreover, the above-described system of the present invention may be used with any number of SCRs, and in any depth of water. Furthermore, as mentioned above, it may be used with a wide variety of offshore facilities and vessels.

While a preferred embodiment has been described above, it will be appreciated that a number of variations and modifications will suggest themselves to those skilled in the pertinent arts. Such variations and modifications are considered to be within the spirit and scope of the present invention, as defined in the claims that follow.

What is claimed is:

1. A steel catenary riser (SCR) system for use with a floating facility on the surface of a body of water, comprising:

a tensioning device located on the floating facility;

an SCR having an upper portion that extends above the surface of the body of water, and having an attachment point located above the surface of the body of water;

a connecting element, connecting the attachment point on the upper portion of the SCR to the tensioning device, so as to controllably apply tension from the tensioning device to the upper portion of the SCR; and a flexible jumper conduit connected between the upper portion of the SCR and the floating facility for conducting fluid from the SCR to the floating facility.

2. The steel catenary riser (SCR) system of claim 1, wherein the tensioning device applies a substantially constant tension to the upper portion of the SCR through the connecting element.

3. The steel catenary riser (SCR) system of claim 1, wherein the connecting element is selected from the group consisting of at least one of a cable, a synthetic rope or line, a chain, and a wire.

4. The steel catenary riser (SCR) system of claim 1, wherein the tensioning device is selected from the group consisting of a rotary winch, a linear winch, a traction winch, and a hydraulic tensioner.

5. The steel catenary riser (SCR) system of claim 1, wherein the jumper conduit is fluidly coupled to the SCR near the attachment point.

6. The steel catenary riser (SCR) system of claim 1, further comprising an attachment fitting at the attachment point to which the connecting element is attached.

* * * * *